US007263978B2

(12) United States Patent
York et al.

(10) Patent No.: US 7,263,978 B2
(45) Date of Patent: Sep. 4, 2007

(54) DUAL PRESSURE ON DEMAND AUTOMOTIVE FUEL PUMP

(75) Inventors: George York, Belleville, IL (US); Larry Carter, Fairfield, IL (US); Paul Meyer, Alton, IL (US)

(73) Assignee: Airtex Products, Fairfield, IL (US)

( * ) Notice: Subject to any disclaimer, the term of this patent is extended or adjusted under 35 U.S.C. 154(b) by 695 days.

(21) Appl. No.: 10/662,864

(22) Filed: Sep. 15, 2003

(65) Prior Publication Data

US 2005/0058549 A1 Mar. 17, 2005

(51) Int. Cl.
*F02M 37/04* (2006.01)

(52) U.S. Cl. ..... 123/497; 123/41.31

(58) Field of Classification Search ..... 123/497, 123/498, 499, 41.31, 456, 451, 478; 417/366, 417/44.2

See application file for complete search history.

(56) References Cited

U.S. PATENT DOCUMENTS 4,756,291 A * 7/1988 Cummins et al. ..... 123/497
4,763,611 A * 8/1988 Kobayashi et al. ..... 123/41.31
4,789,308 A * 12/1988 Tuckey ..... 417/44.8
4,811,709 A * 3/1989 Braun et al. ..... 123/357
4,904,162 A * 2/1990 Suzuki et al. ..... 417/44.4
4,919,102 A * 4/1990 Iwabuchi ..... 123/499
5,593,287 A * 1/1997 Sadakata et al. ..... 417/366
5,961,293 A * 10/1999 Clemmons et al. ..... 417/44.2
6,652,249 B2 * 11/2003 Kenney et al. ..... 417/410.3

* cited by examiner

*Primary Examiner*—Carl S. Miller
(74) *Attorney, Agent, or Firm*—Polster, Lieder, Woodruff & Lucchesi, LC

(57) ABSTRACT

An internal combustion engine (14) has an associated controller (18) controlling operation of the engine. A fuel pump (10) delivers fuel to the engine at more than one pressure (300 kPa, 800 kPa). The fuel pump includes a fuel inlet (34) and a fuel outlet (68). It also includes a motor (38) and pump assembly (36) for drawing fuel through the inlet into the fuel pump and delivering fuel to the outlet at a pressure higher than the pressure at the inlet. An outlet assembly (40) of the pump includes an outlet pressure sensor (76) and a processor (79) which is responsive to an input from the controller to vary the outlet fuel pressure by controlling the speed of the motor.

5 Claims, 3 Drawing Sheets

DUAL PRESSURE ON DEMAND AUTOMOTIVE FUEL PUMP

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to "on-demand" fuel pumps, and more particularly, to such a fuel pump which is capable of delivering fuel at different output pressure levels depending upon engine conditions.

In co-assigned U.S. Pat. No. 5,961,293, there is described an in-tank fuel pump assembly for use with an internal combustion engine. The pump assembly draws low pressure fuel from the fuel tank in which the assembly is installed and delivers fuel at a high pressure to an internal combustion engine. Fuel demand varies depending upon a variety of factors including whether the vehicle is accelerating, decelerating, or traveling at a constant speed, the altitude at which the vehicle is moving, air temperature, and whether the vehicle is traveling on a straight path, ascending or descending, or turning. Modern electronic engine control systems are responsive to inputs from various sensors to control operation of the fuel pump so the pump delivers only the amount of fuel required by the engine at any one time; more or less fuel being supplied as circumstances warrant. This is referred to as "on demand" fuel delivery.

Heretofore, the pressure at which the fuel pump delivered fuel to the engine has been a single pressure level value; e.g. 15 psi, 30 psi, etc. Now, however, it has been found to be desirable to vary both the pressure at which fuel is delivered to the engine, as well as the amount of fuel delivered. Current fuel pump assemblies cannot provide this capability, thereby limiting their performance capabilities and the efficiency of the fuel delivery system of which they are a part. Rather, to achieve a multiple pressure capability, multiple pressure regulators and/or multiple fuel flow regulators are required within the fuel system. These add both cost and complexity to the system.

BRIEF SUMMARY OF THE INVENTION

In accordance with the present invention, an internal combustion engine has an associated controller which is responsive to inputs from various sensors to control operation of the engine. A fuel pump of the invention delivers fuel to the engine at a first and lower pressure (e.g., 300 kPa) and at a second and higher pressure (e.g., 800 kPa) upon a command from the controller. The actual pressure level settings can be any pressure levels within the span of control of a pressure sensor used in the fuel system. The fuel pump has a fuel inlet through which fuel is drawn into the pump and a motor driven pump assembly for delivering fuel to an outlet of the pump at a pressure higher than the pressure at the inlet. An outlet assembly of the pump includes a pressure sensor sensing the outlet pressure and a signal processor responsive to inputs from the controller to vary the outlet fuel pressure between the higher and lower levels depending upon the input from the controller. The desired outlet pressure is achieved by controlling the speed of the pump motor, sensing the output pressure, and comparing the desired pressure against the measured pressure.

The outlet pressure of the fuel pump can be controlled for more than two outlet pressure values by modifying an input signal from the controller to the processor.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
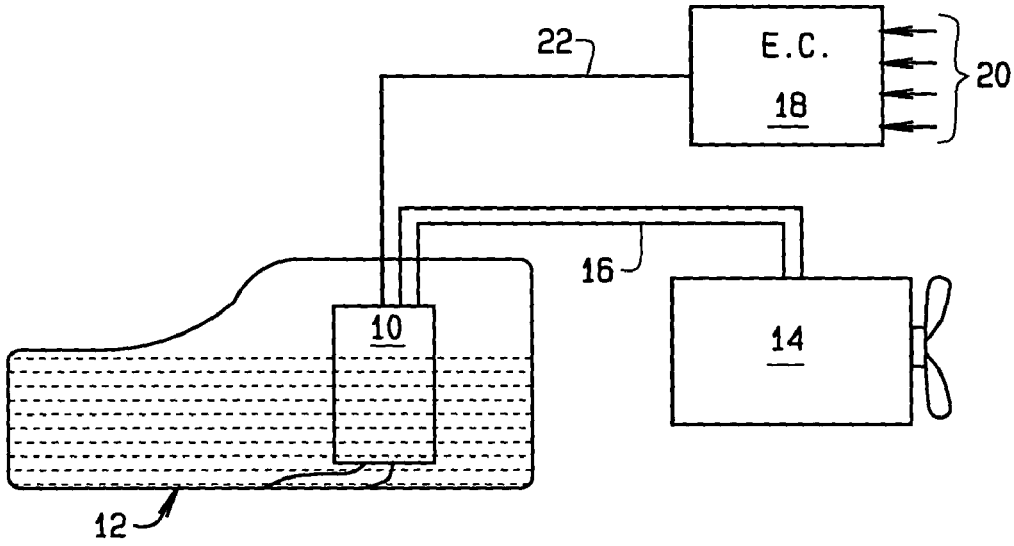
FIG. 1 is a simplified representation of a fuel system including a multiple pressure, on-demand fuel pump of the present invention.

Referring to FIG. 1, a multiple delivery pressure, on-demand fuel pump of the invention is indicated generally 10. The pump is installed in a fuel tank 12 from which it draws fuel for delivery to an engine 14. Fuel pump 10 draws in fuel at a low pressure from the tank and discharges the fuel at a higher pressure into a fuel line 16 which supplies fuel to the engine. An engine controller 18 is responsive to inputs from a variety of sensors or electronic control modules (ECMs) 20 to control operation of engine 14, including the quantity of fuel to be delivered to the engine at any one time. Controller 18 includes a microprocessor (not shown) that processes information from the sensors/ECMs and supplies an output over a control line 22 from the controller to the fuel pump. A signal supplied to the fuel pump over line 22 controls operation of the fuel pump to deliver the required quantity of fuel at a pre-programmed pressure level. This signal is a timing signal (or timing pulse) whose duration is representative of the amount of fuel, and fuel pressure level, required by the engine in accordance with its current operating conditions. As is well-known in the art, pump 10 is an electric motor driven pump and the timing signal controls the amount of time during a given interval the motor is energized to drive the pump to pump fuel.

Heretofore, the fuel pressure at an outlet of pump 10 has been constant, regardless of the quantity fuel being delivered by the pump. However, in accordance with the present invention, fuel pump 10 is now capable of delivering fuel at at least two different outlet pressures in response to control inputs from controller 18.

Figure 2:
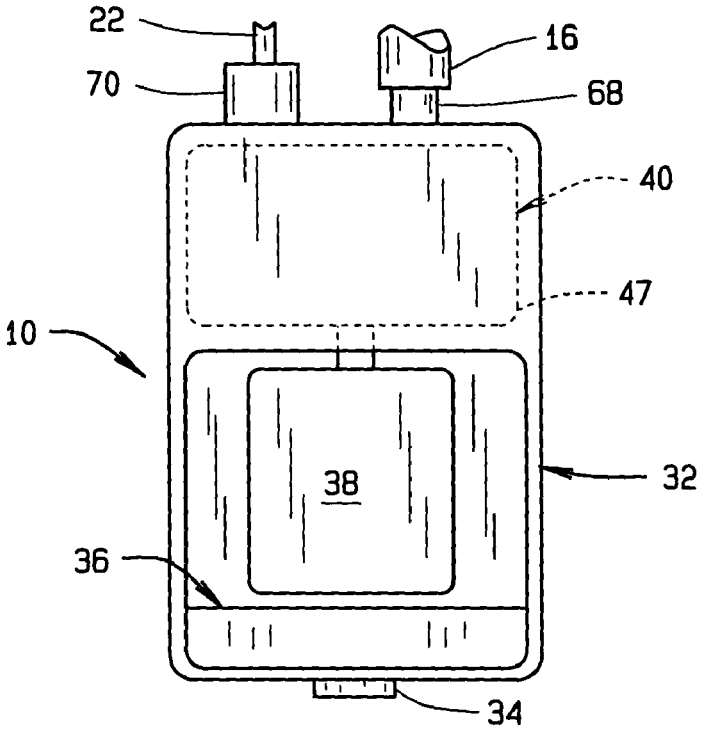
FIG. 2 is an elevational view of the fuel pump, partially broken away.

In FIG. 2, fuel pump 10 is shown to be of a generally cylindrical shape. The entire pump assembly is enclosed in a hollow, cylindrical housing 32. At the lower, inlet end of the pump is an inlet 34 through which fuel from tank 12 is drawn into the pump. Fuel is drawn through the inlet into a pump assembly 36 which is, for example, a gerotor pump assembly. The pump assembly is driven by a DC motor 38 to which the timing signals from controller 18 are supplied. Fuel drawn into the pump flows through the motor to an outlet assembly 40 of the fuel pump which is more fully described hereinafter. Outlet assembly 40 is shown in more detail in FIG. 3.

Figure 3:
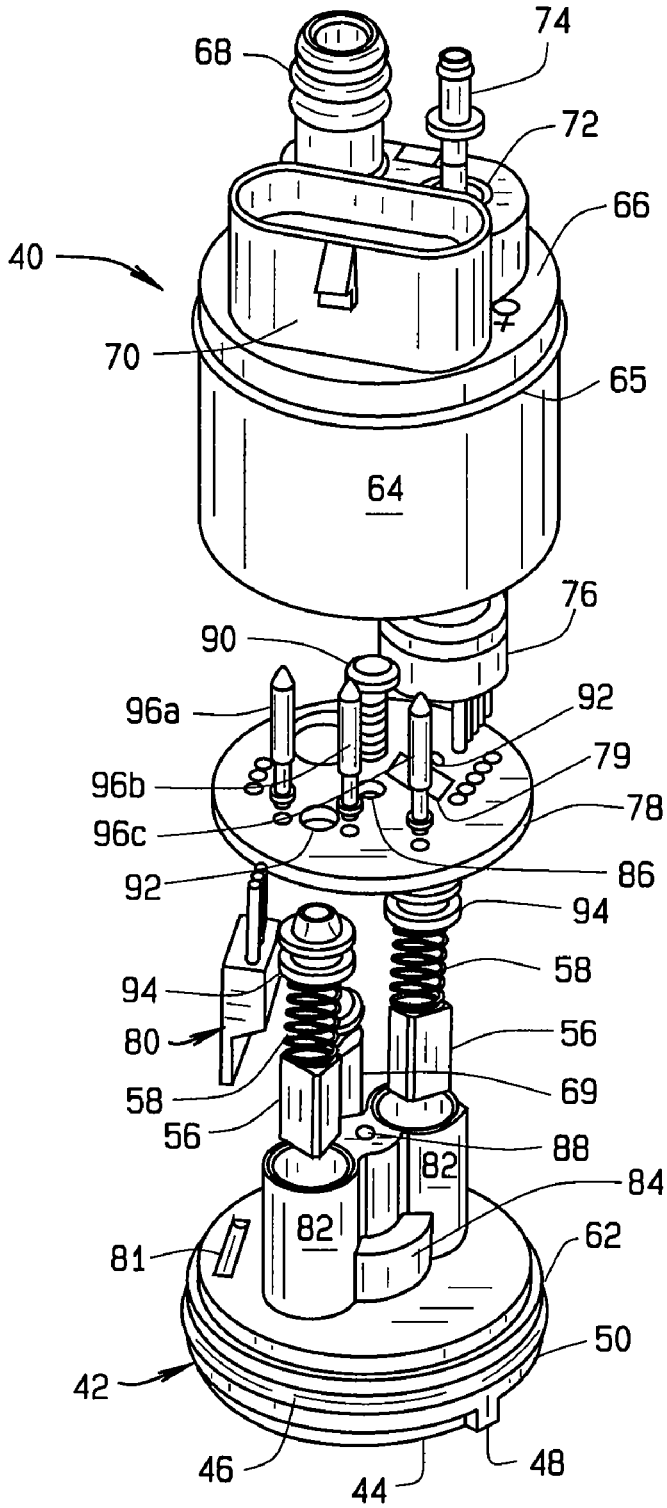
FIG. 3 is an exploded view of an outlet assembly portion of the fuel pump.

Referring to FIG. 3, at the bottom of outlet assembly 40 is a base plate indicated 42. The base plate is of a molded plastic construction. The base plate supports various electrical components for operating the pump, provides a fluid conduit for fuel, houses an armature bearing for motor 38, and provides a base for a potting chamber of the outlet assembly. The lower end 44 of the base plate comprises a cap which fits over the upper end of motor 38. An annular groove 46 in the side of the cap is for an O-ring 47 which bears against an inside surface of housing 32 to seal the outlet assembly from the lower portion of fuel pump 10. A tooth 48 extends from an annular ring 50 defining a lower portion of the groove. The tooth is used to align the outlet assembly with the motor when the pump is assembled.

Figure 4:
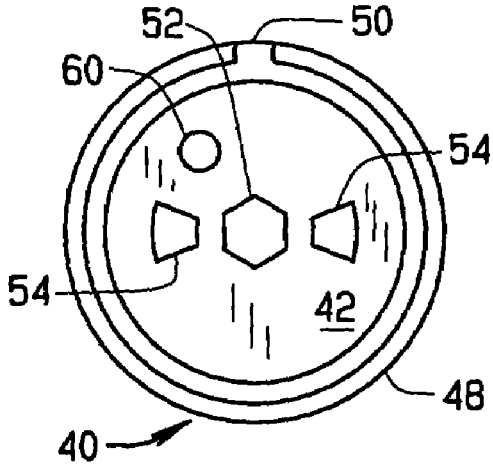
FIG. 4 is a bottom plan view of the outlet assembly.

As shown in FIG. 4, formed in cap 42 of the base plate is a central, hexagonally shaped slot 52. One end of a shalf for motor 38 is received in this slot to mount the motor in the pump assembly. On opposite sides of slot 52 are wedge shaped slots 54. Motor armatures (brushes) 56 extend through these slots. The brushes, which are shown in FIG. 3, have associated springs 58 to hold the brushes in place against the motor's commutator and provide a load sufficient to overcome the normal shock and vibration which occurs. An opening 60 extends through the cap into the outlet assembly. This provides a flow path for the fuel being pumped through the motor to the pump outlet.

Referring again to FIG. 3, an annular ring 62 provides a seating surface for a cover 64 of the outlet assembly. The outlet cover, which has an inverted cup shape, encloses the electrical components housed within outlet assembly 40 and provides a chamber or enclosure for potting these components during a sub-assembly of the pump. As shown in FIG. 2, the outlet assembly is enclosed within housing 32. For this purpose, the outer diameter of the cylindrical sidewall portion of cover 64 corresponds to the inner diameter of housing 32. Further, cover 64 interlocks with housing 32 when the outlet assembly is fitted within the housing to insure proper alignment of the outlet assembly with the rest of the pump. The cover has an annular groove 65 formed in its sidewall adjacent the cap end portion of the cover. An O-ring (not shown) is seated in this groove to form a fluid tight seal between outlet assembly 42 and the inner wall of housing 32.

Cover 64 is of a molded plastic construction and the closed cap end portion 66 of the cover includes a nipple 68 for attachment of the fuel pump outlet to an inlet end of fuel line 16. A vertically extending fuel flow tube 69 is molded into the base plate of cap 42. Opening 60 in the base plate (see FIG. 4) opens into tube 69, and the upper end of the tube discharges fuel flowing through the tube into nipple 68 and the fuel line.

Cap end portion 66 further has a molded electrical connector 70 for attaching power and control lines, including line 22, from electronic controller 18 to the fuel pump. Those skilled in the art will understand that the control line includes a plurality of separate electrical wires and that connector 70 is for a multiple pin connector designed to snap-fit onto connector 70 and not be readily dislodged. Next, the cap end portion of cover 64 has an opening 72 in which is seated a pressure sensing tube 74. The sensing tube is used when pressure is to be sensed externally of the fuel pump.

Mounted within the outlet assembly are a pressure sensor 76, a printed circuit board (PCB) 78 to which the pressure sensor is electrically connected, a signal processor 79, and a transistor 80 which is also electrically connected to the PCB. Signal processor 79 is incorporated on the printed circuit board and is responsive to inputs from controller 18 to control both the amount of fuel delivered by the fuel pump at a given time, and the pressure at which the fuel is delivered. Sensor 76 is responsive to the output pressure of the fuel system and converts a pressure signal into an electrical signal communicated to controller 18 over control line 20. Tube 74 provides a conduit for the pressure sensor; or, the pressure sensor is mounted in outlet tube 69 to sense the pressure.

Transistor 80 comprises a portion of the electrical circuitry controlling power to motor 38. The transistor, which is covered with a metallic heat sink material, is electrically connected to PCB 78. A rectangular slot 81 is formed in the upper face of the base plate and one end of transistor 80 is sized to be received in this slot. A unique feature of the fuel pump of the present invention is that the heat sink on transistor 80 is exposed to the fuel, via the slot. The slot is designed with a thin, controlled amount of "flash" that contacts the heat sink and prevents potting material, in its viscous state, from running through the slot until the material solidifies. When the pump is running, the contact between the heat sink and the fuel draws heat away from the transistor, keeping its operating temperature relatively cool.

In addition to the fuel flow tube 69, also molded into the base plate of cap 42 are a pair of hollow cylindrical supports 82, and a pedestal 84 which extends between the tubes 82. PCB 78 is disk shaped with a diameter slightly smaller than the inner diameter of cover 64. The disk has a central opening 86 and a corresponding opening 88 is formed in the top surface of pedestal 84. PCB 78 seats upon pedestal 84 and a screw 90 is insertable through opening 86 into opening 88 to mount the PCB in place. Although shown in the drawings as being mounted with a screw, it will be understood that the printed circuit board could be soldered directly to the brush fittings.

A pair of opposed openings 92 are also formed in PCB 78. Rubber grommets 94 which fit in these openings provide fluid seals. The grommets/seals each include a seat for one of the springs 58 and their associated brushes 56. The tubes 82 open into the wedge shaped openings 54 in base plate 42. During fabrication of the outlet assembly, the brushes, which are also wedge shaped in cross-section, are inserted through the tubes 82 and the openings 54 at the bottom of the tubes, so to be positioned with motor 38. The seals 94 prevent fluid pressure from penetrating from the spring/brush assembly to the printed circuit board.

Electrical terminals **96*a*-96*c* are electrically connected to the PCB and extend upwardly into electrical connector 70 to mate with the pins in the control line 22 connector which attaches to connector 70. The terminal pins provide an electrical interface between a power supply (not shown) and fuel pump 10. Two of the pins are for power and electrical ground. The third pin is used for a variety of functions. For example, it can be used to provide a signal to controller 18 to provide feedback to the controller about fuel pump 10 operation. In the present application of switching the fuel pump's outlet pressure between two or more pressure levels, the third pin is used to provide a signal path for an outside source, such as controller 18, a relay (not shown), or other electrical device (also not shown) which provides a control signal to the fuel pump. The control signal can be an analog signal such as a voltage signal or a current signal. In either instance, the amplitude of the voltage or current is used to command the fuel pump as to its output pressure level. The signal can also be a digital signal in which the presence of a signal (a digital "1") signifies to the fuel pump that its outlet pressure should be one level; while the absence of a signal (a digital "0") signifies to the fuel pump that its outlet pressure should a different level. The processor 79 incorporated on PCB 78 is programmed to differentiate between the respective analog or digital signals to cause changes in the operation of fuel pump 10**, such as setting the outlet pressure of the pump. As discussed below, the present invention can also incorporate more than two set points for outlet fuel pressure.

Figure 5:
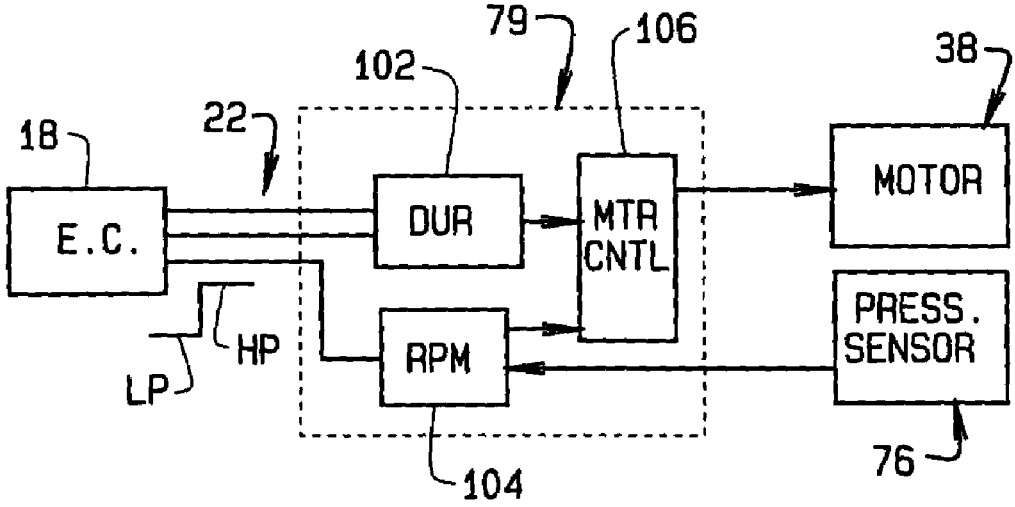
FIG. 5 is a simplified block diagram of operation of the fuel pump to pump fuel at the desired pressure level.

Referring to FIG. 5, signal processor 79 controls both the speed (rpm) of motor 38, and the duration which the motor runs in a predetermined time interval. Motor speed determines the pressure at which the fuel is pumped, the duration the motor runs during a given interval the amount of fuel pumped. These functions are respectively indicated by the duration DUR module 102 and speed RPM module 104 within processor 79. Both modules receive inputs from electronic controller 18 over control line 22. RPM module 102 also receives a sensed outlet pressure input from pressure sensor 76.

To control the outlet pressure from pump 10 between a low pressure 300 kPa, for example, and a high pressure 800 kPa, for example, the input to RPM module 104 is a digital signal. When the level of signal is low (a logic "0"), it signifies the pump is to provide a low pressure or LP output. When the level of the signal is high (a logic "1"), it signifies the pump is to provide a high pressure or HP output. The input to module 104 from pressure sensor 76 indicates whether or not the sensed pump output corresponds to the desired outlet pressure. A resulting output from module 104 is provided to a motor control (MTR CNTL) module 106 to produce the drive signal for the motor.

Those skilled in the art will understand that fuel pump 10 could provide fuel at more than two outlet pressures without departing from the scope of the invention. To achieve this, the signal supplied to module 104 from controller 18 could, for example, be a binary input signal. The value represented by the binary input would indicate which of a plurality of output pressure levels pump 10 is to pump fuel to engine 14. Or, the input signal from controller 18 could be an analog signal having a signal characteristic (amplitude or frequency, for example) which represents the desired output pressure level.

In view of the above, it will be seen that the several objects and advantages of the present invention have been achieved and other advantageous results have been obtained.

Having thus described the invention, what is claimed and desired to be secured by Letters Patent is:

1. A fuel pump for delivering fuel to an internal combustion engine at more than one fuel pressure, the engine having an associated controller controlling operation thereof, comprising:

a fuel inlet and a fuel outlet;

a motor and a pump assembly for drawing fuel through the inlet into the fuel pump and delivering fuel to the outlet at a pressure higher than the pressure at the inlet, the pump assembly having a slot which is in contact with the fuel and the pump assembly having a circuit board;

a processor responsive to an input from the controller to variably control the higher outlet fuel pressure, the processor being mounted on the circuit board positioned within the pump assembly;

a pressure sensor sensing the variable pressure of fuel discharged from the pump, the pressure sensor providing another input to the processor for the processor to determine if the higher outlet fuel pressure is a desired fuel pressure wherein the processor continues to variably control the higher outlet fuel pressure to obtain the desired fuel pressure by controlling speed of the motor such that the higher outlet fuel pressure is a function of the speed of the motor; and a transistor electrically connected to the printed circuit board to control the power to the motor, the transistor having a heat sink covering wherein the transistor partially inserts within the slot so that the heat sink is directly exposed to the fuel via the slot such that the contact between the heat sink and the pumped fuel draws heat energy away from the transistor.

2. The fuel pump of claim 1 further including an outlet assembly within the fuel pump in which the processor and pressure sensor are installed.

3. The fuel pump of claim 1 in which the processor is further responsive to the input from the controller to control the duration which the motor runs during a predetermined time interval, the amount of fuel pumped by the fuel pump being a function of the duration.

4. The fuel pump of claim 1 in which the input from the controller is a binary signal whose value indicates to the processor at which of two outlet pressure levels the fuel pump is to supply fuel.

5. The fuel pump of claim 1 in which the input from the controller is an analog signal having a predetermined signal characteristic which indicates to the processor at which of two outlet pressure levels the fuel pump is to supply fuel.

* * * * *